United States Patent [19]

Tobioka et al.

[11] 4,277,283

[45] Jul. 7, 1981

[54] SINTERED HARD METAL AND THE METHOD FOR PRODUCING THE SAME

[75] Inventors: Masaaki Tobioka; Mitsuo Kodama; Tsuyoshi Asai; Takaharu Yamamoto, all of Itami, Japan

[73] Assignee: Sumitomo Electric Industries, Ltd., Japan

[21] Appl. No.: 971,829

[22] Filed: Dec. 19, 1978

[30] Foreign Application Priority Data

Dec. 23, 1977 [JP] Japan ..... 52-156303

[51] Int. Cl.[3] ..... B22F 3/00; C22C 29/00

[52] U.S. Cl. ..... 75/238; 75/204; 75/211; 75/205

[58] Field of Search ..... 75/238, 204, 205, 211

[56] References Cited

U.S. PATENT DOCUMENTS 3,703,368 11/1972 Rudy ..... 75/175.5

3,708,355 1/1973 Rudy ..... 148/32

4,049,876 9/1977 Yamamoto et al. ..... 75/238

OTHER PUBLICATIONS

Rudy, "Journal of Less Common Metals", vol. 33, #1 1973, pp. 43–70.

*Primary Examiner*—Brooks H. Hunt

*Attorney, Agent, or Firm*—Wenderoth, Lind & Ponack

[57] ABSTRACT

This invention relates to a sintered hard metal for cutting tools and having excellent wear resistance, resistance to thermal deformation, mechanical strength and the like. The present invention resides in the fact that the substrate metal consists of a rich content of the B-1 type hard phase and the surface thin layer consists of a rich content of the ordinary tungsten carbide. B-1 type crystal structure contains one or more Group IVa, Va and VIa metals, carbon, nitrogen and, moreover, tungsten. The thin layer structure has the layer of 5 to 200μ thickness on the surface thereof.

12 Claims, 1 Drawing Figure

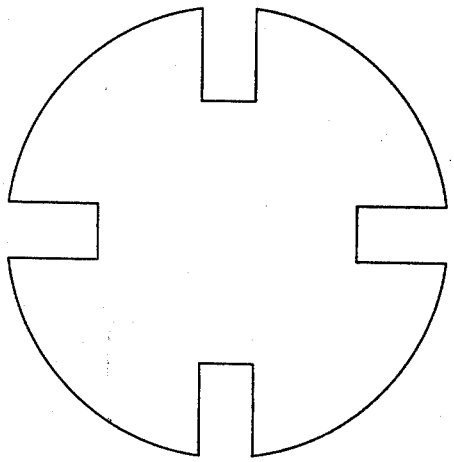

SINTERED HARD METAL AND THE METHOD FOR PRODUCING THE SAME

BACKGROUND OF THE INVENTION

The so-called sintered hard metals comprising WC as its main component, and containing one kind or two or more kinds of carbides and/or carbonitrides of IVa, Va and VIa group metals in the periodic table of elements which are bonded with one kind or two or more kinds of iron group metals are already in practical use. Also, coated sintered hard metal matarials made by coating the surface of said sintered hard metal with wear resistant thin layers, such as, for example, one or more laminated layers of thin layers of TiC, TiCN, TiN, $Al_2O_3$, etc. have already been devised, and such coated sintered hard metals are widely noticed as materials for excellent cutting tools provided with both toughness of the substrate and wear resistance in the surface layer. Therefore, as the recent trend in the art, various efforts have been dedicated to discovering more of such excellent coated sintered hard metals.

However, although said thin surface layer surely is very wear resistant, it is very brittle in comparison to a sintered hard metal, and is apt to immediately form cracks in cutting, said cracks resulting in the failure of the cutting tool when they penetrate the sintered hard metal part.

In usual cases, the sintered hard metal portion of the the coated sintered hard metal is made by bonding WC (tungsten carbide) and one or more kinds of double carbides (designated to the so-called B-1 type hard phase usually having face-centered cubic structure) of IVa~VIa group transition metals in the periodic table by use of Co (cobalt). Although, in general, the more plentiful the B-1 type hard phase contained, the better the wear resistance and resistance to thermal deformation will become and the more the mechanical strength will be decreased.

SUMMARY OF THE INVENTION

The present invention resides in the fact that the substrate metal consists of the rich content of a B-1 type hard phase and the surface thin layer consists of a rich content of the ordinary tungsten carbide. B-1 type hard metal has good wear resistance but poor mechanical strength. On the contrary, WC has good mechanical strength but poor wear resistance.

Thus, said sintered hard metal is covered with a thin layer which has good mechanical strength. As a result, said hard metal can prevent the progression of cracks.

Another object of the present invention is to provide the composition of said coated sintered hard metal excellent in wear resistance and the method for producing the same.

BRIEF DESCRIPTION OF THE DRAWING

The appended drawing shows the sectioned view of a 4-slot body used in the cutting test of the sintered hard metal according to the present invention.

DETAILED DESCRIPTION OF THE INVENTION

The present invention is based on the results of detailed studies particularly into the composition of the sintered hard metal substrate and the sintering phenomenon thereof, with the object of obtaining a sintered hard metal which provides a cutting tool superior to conventional ones.

By the way, some members of the present inventors (hereinafter referred to as the present inventors) previously studied the stability of the B-1 type hard phase in the sintered hard metal containing a hard phase with B-1 type crystal structure and the sintering atmosphere therefor.

In said studies, the present inventors discovered that the use of valence electron concentration (hereinafter described as VEC) is suitable as an indicator of the stability of said hard phase, and found that the B-1 type hard phase was unstable, when VEC≧D, and the crystals were stable when VEC<D. (D will be defined shortly afterwards.) Also, it was found that WC was separated when W was contained in B-1 type hard phase carbonitride crystals which had become unstable in the case when VEC≧D.

As is well known, the molecular formula for the B-1 type hard phase is as follows:

$$(M_A, M'_B, M'_C)(C_U, N_V)_X,$$

where M denotes one or more Group IVa metals such as titanium, zirconium, hafnium, M' one or more kinds of Group Va metals such as vanadium, niobium, tantalum, M'' one or Group Via metals such as chromium, molybdenum, tungsten, C carbon, N nitrogen, and X the ratio of non-metallic constituent elements to the metallic constituent elements.

When $A+B+C=1$ $1 \geqq A \geqq O$, $1 \geqq B \geqq O$, $1 \geqq C \geqq O$ VEC becomes as follows:

$$VEC=4A+5B+6C+40XU+5XV$$

Also, D denotes a function of the nitrogen partial pressure in a sintering atmosphere, and becomes more or less larger when the nitrogen partial pressure in the sintering atmosphere becomes lower.

Howeveer, when the alloy was produced under various conditions by taking the above-described findings into consideration, it was found out that in a sintered alloy with WC-phase content over a constant value, namely, in practical cases, in the alloys with 50% by weight of WC phase, the B-1 type hard phase in the surface layer of the sintered alloy becomes poor, when the sintering atmosphere is a high vacuum (i.e. D is large), and the B-1 type hard phase becomes rich in the surface layer of the sintered alloy, when the sintering atmosphere is that of nitrogen (i.e. D is small).

The reason why such a phenomenon occurs, can be conjectured as due to the following facts.

That is, as a sufficiently large amount of WC-phase is contained in the aforesaid sintered alloy, the separation of WC to some extent will not have large influence on the texture and characteristics of the alloy, that is, when the B-1 type solid solution separates WC according to the following formula $$(M_A, M_{B'}, M_{C'})(C_U, N_V)_X$$
$$(M_{A'}, M_{B'}, M_{C''})(C_{U'}, N_{V'})_X + (C - C')WC$$

where C≧C', the sintered alloy as a whole is primarily sufficiently rich in the WC-phase amount, so that the increase of WC to some extent will have negligible effect.

On the other hand, when the sintering atmosphere is a high vacuum, denitrification will occur, because, in the case of sintering, the B-1 type hard phase in the surface layer of the sintered alloy is in equilibrium with the sintering atmosphere. On the contrary, when the sintering atmosphere is that of nitrogen, the nitrogen content in the B-1 type hard phase in the surface layer increases. Such increase and decrease of the nitrogen amount give large effect to the wettability by the liquid phase generated in sintering. That is, there is correlation between the nitrogen amount in the B-1 type hard phase and the wettability of the liquid phase generated during sintering, and the relation is such that the more the nitrogen content, the worse the wettability. Therefore, when the sintering atmosphere is a high vacuum, the B-1 type hard phase is carried away into the interior of the alloy, since its wettability to the liquid phase is improved, and as a result, the amount of the B-1 type hard phase in the surface layer becomes poor. On the contrary, when the sintering atmosphere is that of nitrogen, the wettability is bad, and the surface layer will become rich in the B-1 type hard phase.

Owing to the above-described reasons, the surface layer can be considered to become poor in the B-1 type hard phase, when the sintering atmosphere is a high vacuum, and to become rich in the nitrogen atmosphere. On the basis of the above-described considerations, the present inventors have arrived at the present method for easily producing a sintered hard metal, wherein the content of the B-1 type hard phase in the surface layer to a definite depth is extremely decreased in comparison to the content thereof in the other part, and further, have discovered the present sintered hard metal which is superior to the conventional sintered hard metals.

That is, the present invention relates to a sintered hard metal and method for producing the same, and is characterized in that said sintered hard metal comprise a phase, which is represented by the molecular formula $(M_A, M'_B, M''_C)(C_U, N_V)_X$ and includes the B-1 type crystal structure containing W as its constituent element, and the WC phase, which amounts to 50% by weight or more of the total amount of the sintered hard metal as hard phases, and further, iron group metals as bonding metals, and in that the content of the phase with the B-1 type crystal structure in the surface layer of a definite depth is less than that in the other part.

In the present invention, it is necessary that the amount of WC phase be 50% by weight or more of the total amount of the sintered hard metal.

In case when the amount of the WC phase is less than 50% by weight of the total amount of the sintered hard metal, the effect of the amount of WC separated by the decomposition of the B-1 type hard phase becomes large, and the effect of the present invention is not revealed. As to the thickness of the part wherein the B-1 type hard phase is absent, it is to be noticed that no effect can be perceived when the thickness is 5μ or less, and the thickness of 200μ or more is not preferred, because the resistance to heat deformation will be lost. It was found that, in order to achieve such requirement, necessary conditions are that, VEC should be as $10.0 \geqq VEC \geqq 8.4$, the sintering atmosphere at the temperature range 1300° C.~1500° C., and the degree of vacuum at 1 Torr or less.

The above-described limitation is due to the fact that the extinction width of the B-1 type hard phase exceeds 200μ, when VEC exceeds 10.0, and it becomes less than 5μ, when VEC becomes less than 8.4.

As to the limitation of the temperature conditions, it is due to the fact that sintering will be insufficient when the temperature becomes lower than 1300° C., and that foams are developed and the mechanical strength diminishes when the temperature exceeds 1500° C.

Also, as to the limitation for the sintering atmosphere, it is due to the fact that the extinction width of the B-1 type hard phase becomes less than 5μ, when the pressure exceeds 1 Torr, but as to the lower limit, no limitation is required in both the theoretical and industrial respects.

On the other hand, for the B-1 type hard phase represented by the molecular formula $(M_A, M'_B, M''_C)(C_U N_V)_X$, it is preferrable that the following conditions be fulfilled:

$$0.01 \leqq V \leqq 0.5,\ 0.60 \leqq X \leqq 1.0$$

As nitrogen has a larger value of VEC in comparison to carbon, it is effective in keeping VEC stabilized at a value above a definite one, and as the present invention is due to the utilization of the denitrification and/or nitrification phenomena of the B-1 type hard phase and sintering atmosphere, nitrogen is necessary and unavoidable, and in order to expect the marked appearance of the effects of denitrification and nitrification phenomena, it is required that V be more than 0.01. On the other hand, when V exceeds 0.5, the sinterability of the alloy becomes worse, so that it is preferred that V be kept below 0.5.

As to X, it is not preferrable that the value becomes less than 0.6, because the strength of the B-1 type hard phase lowers.

Next, it is also preferred that the sintered hard metal contains 0.01 to 0.50% by weight of free carbon. Accompanying the dentrification phenomenon of the B-1 type hard phase, carbon replacement is effected from the WC phase in the circumference and the denitrification phenomenon is accelerated. This phenomenon more favorably occurs, the larger the chemical potential of carbon in the circumference, so that the presence of free carbon is effective in promoting the carbon replacement phenomenon. When the free carbon content is less than 0.01% by weight, no effect can be perceived, and above 0.5% by weight, wear resistance becomes lowered.

Next, although the constituent components of the B-1 type hard phase are free to be selected within the aforesaid range, it is preferable that Ti be included therein, while it is extremely effective for retaining the strength of the B-1 type hard phase.

The sintered hard metal according to the present invention has various general properties such as the toughness, wear resistance, and the like, which are required for cutting tools, and when a coated sintered hard metal was actually prepared by use of the sintered hard metal substrate according to the present invention, described as just expected could be obtained.

As the thin layer to be used on the coated sintered hard metal, are a layer or laminated layers of the mixtures or compounds of one or more IVa, Va, VIa metals and one or more kinds of non-metallic elements selected from the group consisting of boron, carbon, nitrogen and oxygen, and the oxides selected from the group consisting of aluminum and/or zirconium oxide.

Moreover, the sintered hard metal according to the present invention also possesses the properties as described in the following. That is, its rigidity is high, so that the metal is strong against thermal cracks. In the sintered hard metal, when the proportion of the B-1 type hard phase increases, thermal conductivity and Young's modulus thereof decrease.

In the sintered hard metal according to the present invention, since the proportion of the B-1 type hard phase in the surface layer is decreased, both the thermal conductivity and Young's modulus in the surface layer become larger, and as the thermal conductivity of the surface layer is large, thermal gradient is relaxed and thermal stress generated is reduced to markedly reduce loss due to defects, even if very violent thermal stress is generated in the tool surface as is the case in a milling cutter. Also, as the Young's modulus is large, the rigidity of the sintered hard metal as a whole is improved. Especially in recent years, where the price of tungsten has rapidly become more expensive, a cheap and good rigidity cutting tool such as the one produced according to the present invention is suitable to industrial use. Also, when markedly large specific gravity 15.6 of the WC phase is taken into consideration, the sintered hard metal according to the present invention has sufficiently large rigidity, and its specific gravity becomes smaller, because the WC phase in the metal as a whole is poor, and becomes favorable to use for machine design.

Moreover, as the sintered hard metal according to the present invention has excellent toughness in the surface layer, the so-called chipping phenomenon will be reduced.

Also, in the B-1 type hard phase according to the present invention $(M_A, M'_B, M''_C)(C_U, N_V)_X$, it was assured that the same effect can also be obtained in cases when a part of nitrogen which is a non-metallic constituent element was replaced with oxygen. This can be considered to be due to the behavior of oxygen which is the same as that of nitrogen in sintering said sintered hard metal to effect deoxidation and/or oxidation in the sintering atmosphere.

In the following, the present invention will be explained in more detail by the following Examples.

EXAMPLE 1

After mixing 9.6% by weight of TiN, 14.1% by weight of TiC and 76.3% by weight of WC and carrying out hot pressing at 1800° C. for 1 hour, the product was pulverized to form composed carbonitride. It was found that the composed carbonitride had the composition $(Ti_{0.75}W_{0.25})(C_{0.68}N_{0.32})$ by chemical analysis, and the B-1 type crystal structure, from the results of X-ray diffraction analysis.

4.0% by weight of said composed carbonitride, 85.5% by weight of WC, 5.0% by weight of $Ta_{0.75}Nb_{0.25}C$ and 5.5% by weight of Co were weighed and added with acetone, and then were mixed in wet state in a stainless steel ball mill with sintered hard metal balls. To the resulting mixed powder was added 3% by weight of compher, and the mixture was pressed (type $SNU_{432}$) at 2 ton/cm$^2$. The pressed product was sintered at 1450° C. and $10^{-3}$ Torr. The alloy obtained was examined under a microscope to find that the B-1 type hard phase had completely disappeared in the range from the surface to the depth 10μ thereunder.

This alloy was covered with TiC 6μ thick by the well known chemical vapor deposition method, and the product was called as A. For comparison's sake, the above-described pressed product was sintered in an atmosphere with the $N_2$ partial pressure of 10 Torr, and then, was covered in the same manner with TiC 6μ thick, and the product was called as B. Also, an alloy which has quite the same composition of W, Ti, Ta, Nb, and Co as the alloy according to the present invention, but the B-1 type hard phase used therein as a starting raw material having the nitrogen content of less than 0.01 in atomic ratio was mixed, pressed and sintered, and the product obtained was named as C. (for all A, B and C, the type was $SNU_{432}$.)

These three products were subjected to the cutting test under the following conditions:

| Condition 1 | |
|---|---|
| Material to be cut | $SCM_3(H_B = 280)$ |
| Cutting speed | 170 m/min |
| Feed | 0.36 mm/rev |
| Depth of cut | 2 mm |

After 20 minute cutting flank wear, $V_B$ for the insert A was 0.21 mm, for B 0.19 mm, and for C 0.18 mm.

| Condition 2 | |
|---|---|
| Material to be cut (As to its sectional view, cf. FIG. 1). | $SCM_3(H_B = 280)$ 4 slot piece |
| Cutting speed | 100 m/min |
| Feed | 0.18 mm/rev to 0.25 mm/rev. |
| Depth of cut | 4 mm |
| Cutting time | 30 sec. |

When the cutting test of 100 cutting blades for each insert was carried out, the percentage of defect occurrence was 0% for A, 83% for B, and 45% for C, so that the product according to the present invention was found to have no loss in wear resistance and a marked increase in toughness.

EXAMPLE 2

In the same manner as in Example 1, $(Ti_{0.75}W_{0.25})(C_{0.68}N_{0.32})$ was prepared. 6.3% by weight of this double carbonitride, 75.7% by weight of WC, 7.5% by weight of $Ta_{0.75}Nb_{0.25}C$ and 10.5% by weight of Co were weighed and pressed by the same process as shown in Example 1, and the pressed product was sintered at 1380° C. under $10^{-3}$ Torr. The inserts obtained (type $SPU_{422}$) were coated with TiC 6μ thick by the same process as described in Example 1. These inserts were subjected to the 100 cutting blade test under the condition 2 of Example 1 to obtain its percentage of defect occurence as 3%, but, on the contrary, coated inserts which were prepared by coating TiC 6μ thick on the commercially available ISO P-40 alloy, showed the percentage defect occurrence of 86%.

EXAMPLE 3

In the same manner as in Example 1, 85.5% by weight of WC, 4.0% by weight of $(Ti_{0.75}W_{0.25})(C_{0.68}N_{0.32})$, 5% by weight of $(Ta_{0.75}Nb_{0.25})C$ and 5.5% by weight of Co were weighed and the amount of carbon contained was suitably adjusted. The mixture was pressed (type $SNU_{432}$) by the same process as in Example 1, and the pressed products were sintered at 1450° C. and $10^{-3}$ Torr. After sintering, the products were subjected to carbon analysis, and classified and denoted as follows:

| | |
|---|---|
| Those wherein no free carbon is separated | D |
| Those wherein 0.03% by weight of free carbon is separated | E |
| Those wherein 0.15% by weight of free carbon is separated | F |

-continued

| | |
|---|---|
| Those wherein 0.30% by weight of free carbon is separated | G |
| Those wherein 0.45% by weight of free carbon is separated | H |
| Those wherein 0.60% by weight of free carbon is separated | I |

Those inserts were covered with TiC 6μ thick and $Al_2O_3$ 1μ thick by the chemical vapor deposition method. These inserts were tested under the condition that the material to be cut is $SCM_3(H_B=280)$, cutting speed 170 m/min, feed 0.36 mm/rev. and depth of cut 2 mm, to determine the cutting life until the flank wear reaches 0.25 mm. Cutting was able to be continued for 37 min by D, 36 min. by E, 29 min. by F, 21 min. by G, and 16 min by H, but only 2 min by I. For the sake of comparison, a commercially available $Al_2O_3$/TiC double coated sintered hard metal (hereinafter referred to as J) was tested, and was found to the be usable for 22 min.

Then, these inserts were subjected to 100 cutting blade test for each insert under the condition 2 as shown in Example 1. The percentage of failure was 24% for D, 12% for E, 6% for F, 0% for G, 0% for H, and 0% for I, on the contrary, the percentage of failure for J was 49%.

EXAMPLE 4

Various alloys were prepared by the same method as described in Example 1. The alloy composition and the sintering atmosphere for their preparation are shown in the following Table 1. For the B-1 type hard phases are shown their raw material compositions, and the type was $SNU_{432}$ in all cases. The sintering was carried out at 1380° C. for 1 hour, and the amount of Co was 10% by weight.

TABLE 1

| | Amount of WC (% by weight) | Composition of B-1 type hard phases | Sintering atmosphere |
|---|---|---|---|
| i | 40 | $(Ti_{0.75}W_{0.25})(C_{0.8}N_{0.2})$ | $10^{-3}$ Torr |
| j | 50 | $(Ti_{0.75}W_{0.25})(C_{0.8}N_{0.2})$ | $10^{-3}$ Torr |
| k | 90 | $(Ti_{0.75}W_{0.25})(C_{0.8}N_{0.2})$ | $10^{-3}$ Torr |
| l | 90 | $(Ti_{0.75}W_{0.25})(C_{0.8}N_{0.2})$ | $10^{-3}$ Torr |
| m | 90 | $(Ti_{0.75}W_{0.25})(C_{0.8}N_{0.2})$ | $PN_2$ = 10 Torr |
| n | 90 | $(Ti_{0.5}W_{0.5})(C_{0.98}N_{0.02})$ | $10^{-3}$ |
| o | 90 | $(Ti_{0.9}W_{0.1})(C_{0.09}N_{0.1})$ | $10^{-3}$ |
| p | 90 | $(Ta_{0.5}W_{0.5})(C_{0.5}N_{0.5})$ | $10^{-3}$ |

VEC of the B-1 type hard phases of various kinds of alloys shown in Table 1 is 8.70 for i to m, 9.02 for n, 8.30 for o, and 10.0 for p.

Examination of inserts after sintering and being cut into sections showed that in the i-insert, the B-1 type hard phase was somewhat increased in the layer 20μ thick under the surface in comparison to its amount in the inside, but on the contrary, in the j-th insert, the B-1 type hard phase was decreased in the layer 20μ thick under the surface, and in the k-th insert the B-1 type hard phase was perfectly lost in the layer 20μ thick under the surface. While the B-1 type hard phase was perfectly lost in the layer 20μ thick under the surface of the l-th insert, in the m-th insert, only B-1 type hard phase and Co could be perceived in the layer 5μ thick under the surface, and WC was perfectly lost therein. The n-th insert was pefectly uniform from the surface to the inside, and while in the o-th insert, the B-1 type hard phase disappeared in the layer 100μ thick from the surface, the B-1 type hard phase was lost in the p-th insert in the layer 200μ thick from the surface.

Among these inserts, k, o and p were covered with TiN 6μ thick by the known method, and the products were subjected to cutting test under the condition that the material to be cut is $SCM_3(H_B=280)$, cutting speed 170 m/min, feed 0.36 mm/rev., and the depth of cutting 2 mm, until to reach the life of flank wear of 0.2 mm. Time of possible cutting was 36 min for k, 31 min for o, and 21 min for p. By the way, a commercially available TiN-coated sintered hard metal was able to continue cutting for 37 minutes, and the substrate thereof only was able to continue cutting for 16 minutes.

Next, with the k-th, o-th, and m-th inserts, a plate 200×100 of the material to be cut $SCM_3(H_B=280)$ was subjected to milling under the condition that the cutting speed is 108 m/min, feed 0.18 mm/tooth and depth of cut 2 mm (the cutter being type NFL06R).

The number of thermal cracks in the cutting edge during 5 times of passing through the milling was counted to get 1 crack in k and 6 cracks in o, but, in the case of m, cutting became impossible due to thermal cracks after passing twice.

Each insert was subjected after sintering to oxygen analysis to obtain the results shown in Table 1, wherein i~ to m-th alloys showed that 1/100 of the nitrogen contained in respective B-1 type hard phases was replaced with oxygen in atomic ratio, and the oxygen replacement was 9/100 in the n-th alloy, 2.2/100 in the o-th alloy, and 0.3/100 in the p-th alloy.

We claim:

1. A sintered hard metal which comprises:

a core portion having a phase represented by the molecular formula $(M_A, M'_B, M''_C)(C_U, N_V)_X$ and having a B-1 type crystal structure containing W as one of the constituent elements thereof, and a WC phase in an amount of at least 50% by weight of the total sintered hard metal content, for hardness, and iron group metals for bonding, and a surface portion of 5 to 200μ thickness wherein the proportion of the phases having the aforesaid B-1 type crystal structure is lower than that in the core portion in which:

M consists of Group IVa metallic elements, M' consists of Group Va metallic elements, M'' consists of Group VIa metallic elements, C represents carbon, N represents nitrogen, the suffixes A, B, C, U and V represent the atomic ratios respectively, X represents the ratio of non-metallic constituent elements to the metallic constituent elements and said metal having the following relationships:

$$A + B + C = 1 \quad 1 \geqq A \geqq O, \; 1 \geqq B \geqq O, \; 1 \geqq C \geqq O \quad U + V = 1$$
$$10.0 \geqq 4A + 5B + 6C + X(4U + 5V) \geqq 8.4$$

2. The sintered hard metal according to claim 1, having the following relationship:

$$0.05 \leqq V \leqq 0.5, \; 0.60 \leqq X \leqq 1.0$$

3. The sintered hard metal according to claim 1, wherein the surface layer is 5 to 100μ thick and contains no phase having the B-1 type crystal structure.

4. The sintered hard metal according to claim 1, which contains 0.01 to 0.50% by weight of free carbon.

5. The sintered hard metal which is produced by covering the surface of said sintered hard metal according to claim 1 with a layer or laminated layers of mixtures or compounds of one or more Group IVa-, Va-, and VIa transition metals in the periodic table and one or more non-metallic elements selected from the group consisting of boron, carbon, nitrogen and oxygen, and oxides selected from the group consisting of aluminum and/or zirconium oxide.

6. The sintered hard metal according to claim 1, wherein in the non-metallic constituent elements of the phase having B-1 type crystal structure, a part of nitrogen is replaced by oxygen.

7. A method for producing a sintered hard metal wherein a composite carbonitride represented by the molecular formula $(M_A, M'_B, M''_C)(C_U, N_V)_X$ and having B-1 type crystal structure containing W as one of the constituent elements thereof, WC in an amount of above 50% by weight of the total amount of the sintered hard metal, and iron group metals, are mixed and then are pressed into a predetermined shape to form a green compact which is then sintered in a vacuum of less than 1 Torr at a temperature 1300° C. 1500° C.

8. The method for producing a sintered hard metal according to claim 7, wherein M consists of at least one Group IVa group metal elements.

9. The method for producing a sintered hard metal according to claim 7, wherein M′ consists of one kind or two or more Group Va metal elements.

10. The method for producing a sintered hard metal according to claim 7, wherein M″ consists of one kind or two or more Group VIa metal elements.

11. The method for producing a sintered hard metal according to claim 7, wherein, in the molecular formula $(M_A, M'_B, M''_C)(C_U, N_V)_X$, A, B, C, U and V represent respectively atomic ratio, and X the ratio of the non-metallic constituent elements in relation to the metallic constituents elements, and further, having the following relationships:

$$A + B + C = 1,\ U + V = 1,$$
$$10.0 \geqq 4A + 5B + 6C + X(4U + 5V) \geqq 8.4$$
$$0.05 \leqq V \leqq 0.5,\ 0.60 \leqq X \leqq 1.0$$

12. The method for producing a sintered hard metal wherein a part of the nitrogen of the composite carbonitride having B-1 type crystal structure is replaced by oxygen.

* * * * *